United States Patent [19]

Conway

[11] 4,292,909

[45] Oct. 6, 1981

[54] SPILL OVERFLOW PREVENTION SYSTEM FOR TANKER VESSELS

[76] Inventor: Charles S. Conway, Featherbed La., New Vernon, N.J. 07976

[21] Appl. No.: 106,276

[22] Filed: Dec. 21, 1979

[51] Int. Cl.[3] ..... B63B 25/12

[52] U.S. Cl. ..... 114/74 R; 137/575; 141/126

[58] Field of Search ..... 141/126; 220/85 S, 85 A; 114/74 R, 256, 257; B7/575, 551, 527

[56] References Cited

U.S. PATENT DOCUMENTS

| | | | |
|---|---|---|---|
| 3,331,391 | 7/1967 | Merdinyan | 137/527 |
| 3,844,239 | 10/1974 | McLaughlin | 114/74 R |
| 3,857,350 | 12/1974 | Rohan | 137/551 |
| 3,859,944 | 1/1975 | Warner | 114/74 R |
| 3,926,135 | 12/1975 | De Gregorio | 114/74 R |
| 4,142,470 | 3/1979 | Zauss | 137/575 |

FOREIGN PATENT DOCUMENTS

| | | | |
|---|---|---|---|
| 52-5183 | 1/1977 | Japan | 114/74 R |

*Primary Examiner*—Sherman D. Basinger
*Attorney, Agent, or Firm*—Kenyon & Kenyon

[57] ABSTRACT

An improved spill overflow prevention system for tanker vessels comprising a longitudinally disposed trunk line, branch lines coupled at one end to the trunk line and at the other end to the cargo compartments of the vessel, valves coupled to the branch lines intermediate the ends thereof for permitting the free flow of fluid chemical and petroleum products from the cargo compartments to the trunk line through the branch lines, and a retention tank disposed in the vessel and coupled to the trunk line for receiving fluid chemical and petroleum products from the trunk line. Fluid chemical and petroleum products overflowing from the cargo compartments of the vessel are directed from the compartments through the branch lines and trunk line to the retention tank thereby preventing overflow of the products externally of the compartments. The branch and trunk lines are dimensioned so as to prevent any overpressurization of the compartments during an overflow.

9 Claims, 3 Drawing Figures

SPILL OVERFLOW PREVENTION SYSTEM FOR TANKER VESSELS

BACKGROUND OF THE INVENTION

1. Field of the Invention

The present invention relates to an automatic system for preventing external cargo spillage from tanker vessels resulting from the overflow of cargo from the cargo compartments of the vessel during loading thereof.

2. Description of the Prior Art

Presently, cargo comprising fluid chemical and petroleum products, such as, for example, oil, is loaded into tanker vessels by means of transfer hoses and cargo pipelines which are coupled to inlets communicative with the cargo compartments of the vessel. It sometimes occurs during loading or transfer of cargo that the fluid and chemical products continue to flow after the compartments are full. As a result, cargo overflows through ullage openings, gas vents or other deck apertures communicative with the compartments, over the deck of the vessel and into the water, thereby causing a spill and producing water contamination, atmospheric pollution, as well as a fire and explosion hazard.

Cargo spills are the result of a variety of causes. One, for example, is negligence on the part of personnel in charge of loading the cargo compartments of the vessel. Another is a faulty loading valve, for example, a leaky valve or a foreign substance wedged under the valve gate. Others are a leaking line under pressure within the cargo compartments; an increase, without notice, of the vessel loading rate; and a broken valve reach rod or other control segment during closing of an inlet valve after a cargo compartment has been filled. Such cargo overflows can cause significant pollution of coastal waterways, particularly when the cargo being loaded is crude oil. For example, depending upon the size of the vessel and the flow rate of the cargo during loading and the duration of the overflow before it is discovered, anywhere from several barrels to several thousand barrels of oil may be lost from a single cargo spill caused by an overflow.

Cargo tank overfill control systems have been devised to prevent overflows from cargo compartments of a tanker vessel during loading. High level alarms and continuous tank cargo level indicators, for example, are used to monitor cargo tank levels in a vessel during loading. While such devices are helpful, they are subject to malfunctions, are dependent on human monitors, and do not automatically prevent pollution, and these characteristics make such devices unacceptable for vessels carrying cargoes such as crude oil having the potential of creating serious environmental pollution in coastal waterways and ports in the event of spillage from the vessel caused by an overflow during loading. Remotely-actuated, quick-closing shut off valves have been used in such vessels to help reduce overflows but it has been found that such valves can create excessive surge pressures in the cargo transfer hoses and pipelines used to load the vessel which are great enough to rupture the hoses and line thereby resulting in the spillage of cargo. Such valves are, moreover, still dependent on human attention for effective operation.

SUMMARY OF THE INVENTION

It is therefore an object of the present invention to provide an automatic spill overflow prevention system for tanker vessels which overcomes the aforementioned disadvantages of prior tank fill indicators and overflow handling systems and automatically prevents the spillage of fluid chemical and petroleum products during loading operations or cargo transfer operations in the vessel without the danger of causing a rupture of the hoses and pipelines used to load the vessel or the bulkheads of the vessel.

It is also an object of the present invention to provide an improved spill overflow prevention system for tanker vessels which will reduce the pollution of the natural environment, particularly the pollution of coastal and intercoastal waterway areas and ports.

These and other objects of the invention are achieved in a tanker vessel for the transportation of fluid chemical and petroleum products in water. The vessel includes a hull comprising a bottom and sides, a top deck, a plurality of watertight cargo compartments disposed within the hull between the top deck and the hull bottom for receiving the fluid chemical and petroleum products, and means coupled to the cargo compartments for filling the compartments with the fluid chemical and petroleum products. The improvement of the invention comprises longitudinally disposed trunk line means, branch line means coupled at one end to the trunk line means and at the other end to the cargo compartments, valve means coupled to the branch line means intermediate the ends thereof for permitting the free flow of fluid chemical and petroleum products from the cargo compartments to the trunk line means through the branch line means, the branch line means being dimensioned so as to prevent overpressurization of the cargo compartments during the flow of fluid chemical and petroleum products from the compartments to the trunk line means, and retention tank means disposed in the vessel and coupled to the trunk line means for receiving fluid chemical and petroleum products from the trunk line means. Fluid chemical and petroleum products overflowing from the cargo compartments during filling thereof are directed from the cargo compartments through the branch line means and the trunk line means to the retention tank means thereby preventing the spillage of the fluid chemical and petroleum products externally of the cargo compartments.

The improved spill overflow system of the present invention will significantly reduce safety hazards, cargo loss, and the pollution of coastal waterways and ports caused by tank overflows during loading operations, transfers, discharge or cargo expansion in a tanker vessel. This is achieved by utilizing a retention tank, specifically one or more empty tanks, such as a cofferdam, void space or ballast tank or other suitable vessel space, or a plenum, and directing any overflows from the cargo compartments into such a retention tank.

These and other novel features and advantages of the present invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
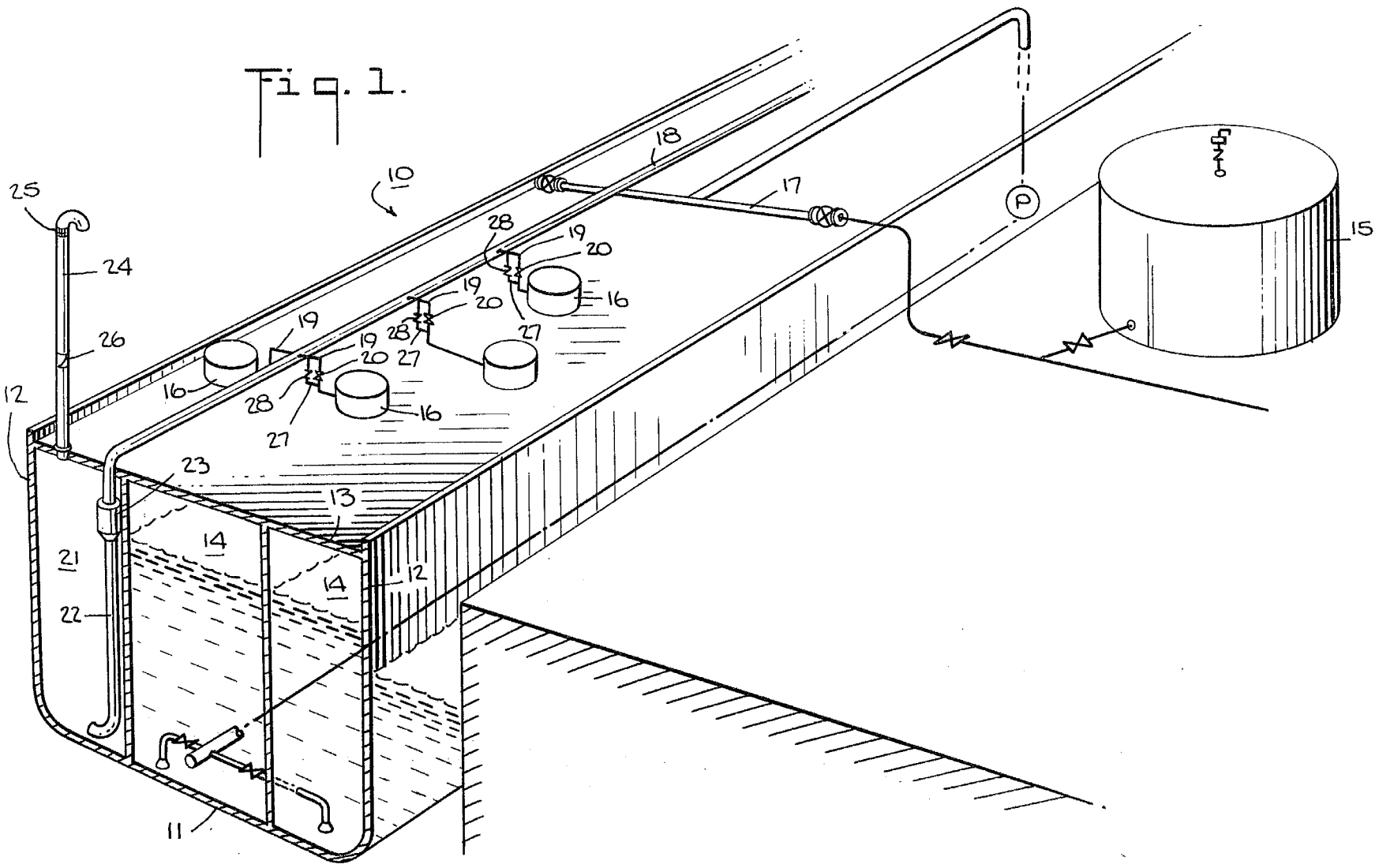
FIG. 1 is a perspective view, partially in cross-section, of a tanker vessel incorporating an improved spill overflow prevention system constructed according to the present invention.
Figure 2:
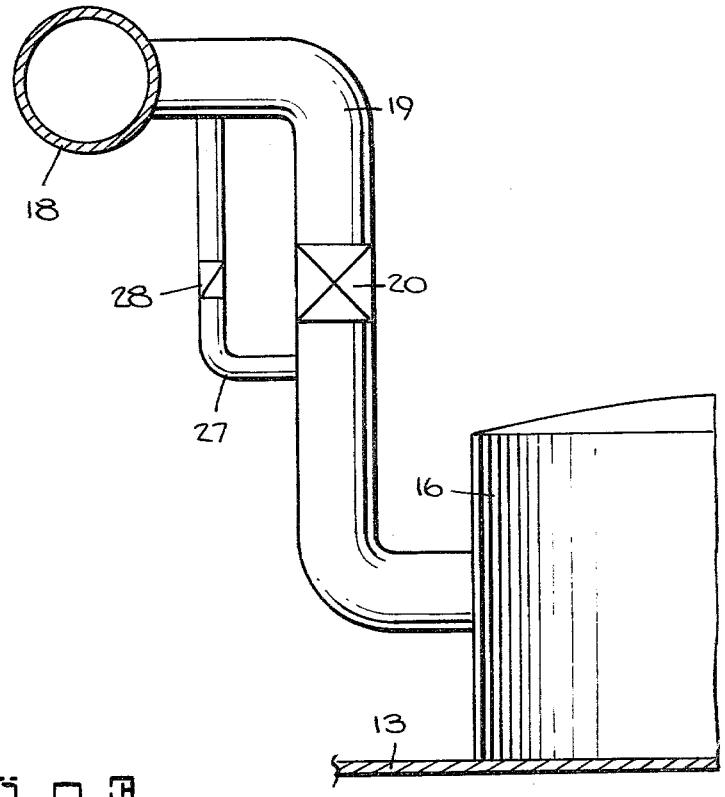
FIG. 2 is a partial, cross-sectional view of the improved spill overflow prevention system illustrated in FIG. 1 showing the construction of the trunk line, branch line and control valve of the system.
Figure 3:
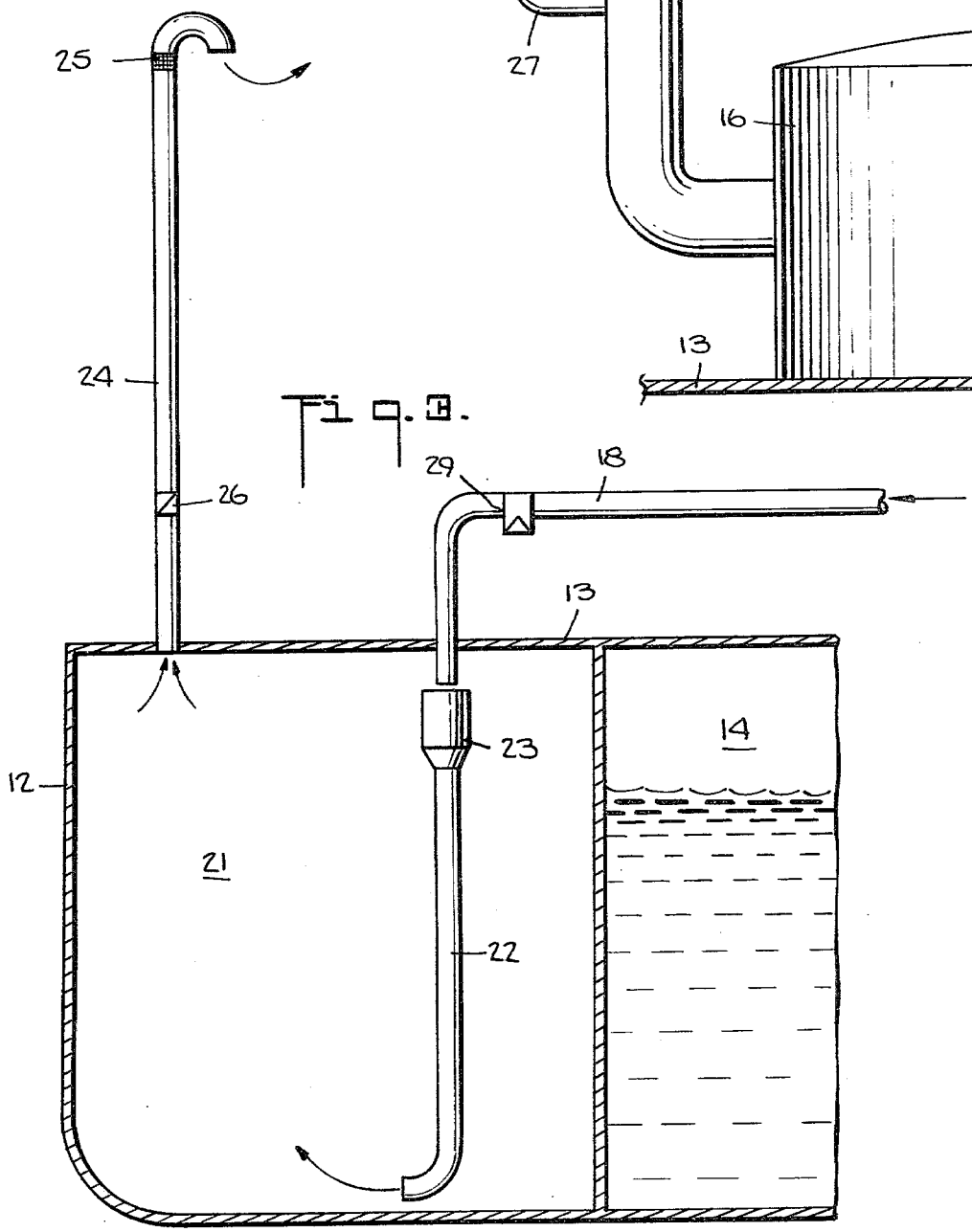
FIG. 3 is a partial, cross-sectional view of the improved spill overflow prevention system illustrated in FIG. 1 showing the construction of the retention tank.

Referring now to the drawings, there is shown a tanker vessel generally identified by the reference numeral 10 which includes a hull comprising a bottom 11 and sides 12, a top or main deck 13, and a plurality of watertight cargo compartments 14. The cargo compartments are disposed within the hull between top deck 13 and hull bottom 11 for receiving cargo comprising fluid chemical and petroleum products, for example, crude oil, from a land storage tank 15. Cargo expansion trunks 16 are coupled to and open downwardly into each of cargo compartments 14. A cargo pipeline 17 is coupled to each of the cargo compartments 14 for filling the compartments with cargo from land storage tank 15.

Vessel 10 includes a longitudinal trunk line 18, which can be disposed either above or below top deck 13, and a plurality of branch lines 19 which are coupled at one end to trunk line 18 and at the other end to cargo expansion trunks 16. A plurality of valves 20, which may comprise either non-return clapper valves, weighted or spring-controlled to produce the required back pressure for vapor venting, or positive type closure valves, the latter preferably being bufferfly-type valves, are coupled to the branch lines 19 intermediate the ends thereof for permitting the free flow of fluid chemical and petroleum products, i.e., the liquid cargo, from cargo expansion trunks 16 to trunk line 18 through branch lines 19. If non-return clapper valves are used, the valves permit the free flow of the liquid cargo only from cargo expansion trunks 16 to trunk line 18 through branch lines 19. A cargo retention tank 21, which may comprise either a wing tank or a plurality of interconnected tanks of the vessel, is coupled to trunk line 18 for receiving cargo from the trunk line. An overflow pipe 22 is disposed within the retention tank 21 for directing the cargo overflow within the retention tank and has an enlarged opening 23 at one end thereof which is disposed below the end of trunk line 18. The latter extends downwardly and opens into the retention tank 21 just below top deck 13. The enlarged opening 23 of pipe 22 receives cargo overflow from trunk line 18 and is spaced slightly apart from the end of the trunk line in tank 21 in order to permit gases, for example, hydrocarbon gases and the like to escape from the trunk line into the retention tank 21. A plurality of apertures may also be disposed about the periphery of opening 23 to permit gases to escape into retention tank 21. The retention tank is provided with an exhaust vent 24 which includes a flame screen 25 and a pressure/vacuum relief valve 26 for venting gases from the retention tank to the atmosphere. Gases are vented from the cargo compartments 14 to the atmosphere during filling of the compartments through trunk line 18 and branch lines 19 to retention tank 21. A plurality of bypass lines 27 are coupled to branch lines 19 intermediate the ends thereof and in parallel relationship therewith, each including a pressure/vacuum relief valve 28, which preferably comprises a closed type pressure/vacuum relief valve, coupled to the bypass line intermediate its ends, for venting gases from cargo compartments 14 to retention tank 21 through trunk line 18 and branch lines 19 when valves 20 are positive type closure valves and are closed, i.e., during all operations on the vessel except when filling any cargo compartments or transferring cargo between the compartments. When valves 20 comprise non-return clapper valves, the bypass lines 27 and valves 28 permit vacuum relief in the cargo compartments 14. It should be noted that the bypass lines 27 are not required if the vessel is retrofitted with the spill overflow prevention system of the invention and already has an existing venting system which is retained.

Branch lines 19 are dimensioned, i.e., have a diameter which is large enough to prevent overpressurization of the cargo compartments during an overflow while loading or transferring cargo. The term "overpressurization" means a pressure build-up in the cargo compartments due to the pumping of cargo into the compartments at high pressure which would cause structural damage to the bulkheads of the vessel. Such a pressure build-up is relieved by sizing the branch lines 19 so that the lines have a diameter which is greater than the diameter of the filling lines or pipes used to load the compartments to such an extent that the pressure in the cargo compartments is reduced to a level below the maximum the vessel bulkheads can withstand before sustaining damage. It should be noted that both trunk line 18 and branch lines 19 may comprise rectangular or square-shaped ducts, or partially circular pipes, as well as the circular pipes illustrated in the drawings, and can be disposed either above or below the deck of the vessel. The diameter of trunk line 18, as a general rule, will always be considerably greater than that of the branch lines 19 and for that reason usually is not a factor in overpressurization of the cargo compartments 14. If, however, for some reason a back pressure were produced by the trunk line, for example, if the trunk line had a diameter which was less than that of the branch lines, this pressure would have to be considered along with the pressure produced by the branch lines in determining the dimensions of the lines which will keep the pressure in the compartments 14 below the maximum allowable overpressure.

A line flow alarm 29 is coupled in series with trunk line 18 for indicating the flow of cargo in the trunk line. In addition, retention tank 21 preferably comprises a side compartment of vessel 10 in order to provide an additional indication of the flow of cargo through the trunk line and of an overflow by causing the vessel to heel over slightly. This provides an additional level of protection in the event that the line flow alarm fails to indicate and/or crewmen working on the vessel are inattentive or are not present and fail to detect an overflow from the compartments through the trunk line.

In operation, in the event that the volume of cargo loaded into one or more of the cargo compartments of the vessel exceeds the capacity of the compartments and overflows, the excess cargo is directed through cargo expansion trunk 16 and branch line 19 to the trunk line 18 and flows through the trunk line into retention tank 21. If valves 20 comprise positive-type closure valves, the valves are opened prior to commencement of the loading operation. If non-return clapper valves are used, the valves will automatically open when an overflow occurs. The flow through the trunk line 18 is indicated by the flow alarm 29, which produces an audible and/or visible alarm. Cargo entering the retention tank is received by enlarged opening 23 of overflow pipe 22 and is directed by the pipe within the tank to the tank bottom. Gases present in cargo compartments 14, for example, hydrocarbon gases produced by petroleum products, are expelled from the compartments during loading or cargo transfer and flow through branch lines 19 into trunk line 18 and escape from the end of the trunk line in retention tank 21. The gases are then vented under pressure to the atmosphere through exhaust vent 24. The exhaust vent 24 is preferably designed so that it terminates at its open upper end at a level above the vessel's deck which is well clear of personnel areas and any hazard of ignition on the vessel. It should be noted that a closed tank loading system is required during loading or transfer operations on the vessel. This system can be either an automatic or manual closed ullage system or a simple glass visor having an internal wiper device fitted in each ullage opening. The spill overflow system of the present invention may also be used for bunker tanks, chemical tanks, etc., to prevent overflow loss and hazard in the same manner as with cargo compartments.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a tanker vessel for the transportation of fluid chemical and petroleum products in water, which vessel includes a hull comprising a bottom and sides, a top deck, a plurality of watertight cargo compartments disposed within the hull between the top deck and the hull bottom for receiving the fluid chemical and petroleum products, and means coupled to said cargo compartments for filling said compartments with said fluid chemical and petroleum products, the improvement comprising, longitudinally disposed trunk line means, branch line means coupled at one end to said trunk line means and at the other end to said cargo compartments, valve means, coupled to said branch line means intermediate the ends thereof, for permitting the free flow of fluid chemical and petroleum products from said cargo compartments to said trunk line means through said branch line means, said branch line means being dimensioned so as to prevent overpressurization of said cargo compartments during the flow of said fluid chemical and petroleum products from said compartments to said trunk line means, retention tank means disposed in said vessel and coupled to said trunk line means for receiving fluid chemical and petroleum products from said trunk line means, vent means for said cargo comparments including bypass line means coupled to said branch line means intermediate the ends thereof and in parallel relationship therewith, and pressure/vacuum relief valve means, coupled to said bypass line means intermediate the ends thereof, whereby fluid chemical and petroleum products overflowing from said cargo compartments during filling thereof are directed from said cargo compartments through said branch line means and said trunk line means to said retention tank means thereby preventing the spillage of said fluid chemical and petroleum products externally of said cargo compartments.

2. The improvement recited in claim 1, wherein said pressure/vacuum relief valve means comprises a closed type pressure/vacuum relief valve.

3. The improvement recited in claim 1, further comprising vent means coupled to said retention tank means for venting gases from said retention tank means to the atmosphere.

4. The improvement recited in claim 1, wherein said valve means comprises a positive type closure valve.

5. The improvement recited in claim 1, wherein said valve means comprises a non-return clapper valve.

6. In a tanker vessel for the transportation of fluid chemical and petroleum products in water, which vessel includes a hull comprising a bottom and sides, a top deck, a plurality of watertight cargo compartments disposed within the hull between the top deck and the hull bottom for receiving the fluid chemical and petroleum products, and means coupled to said cargo compartments for filling said compartments with said fluid chemical and petroleum products, the improvement comprising, longitudinally disposed trunk line means, branch line means coupled at one end to said trunk line means and at the other end to said cargo compartments, valve means, coupled to said branch line means intermediate the ends thereof, for permitting the free flow of fluid chemical and petroleum products from said cargo compartments to said trunk line means through said branch line means, said branch line means being dimensioned so as to prevent overpressurization of said cargo compartments during the flow of said fluid chemical and petroleum products from said compartments to said trunk line means, retention tank means disposed in said vessel and coupled to said trunk line means for receiving fluid chemical and petroleum products from said trunk line means, liquid overflow pipe means disposed within said retention tank means, said trunk line means having an end thereof extending downwardly and opening into said retention tank means, said pipe means having an enlarged opening at one end disposed below said end of said trunk line means in said retention tank means for receiving fluid chemical and petroleum products from said trunk line means, said pipe means directing said fluid chemical and petroleum products within said retention tank means, said enlarged opening of said pipe means being spaced apart from said end of said trunk line means in said retention tank means for directly venting gases from said trunk line means into said retention tank means, whereby fluid chemical and petroleum products overflowing from said cargo compartments during filling thereof are directed from said cargo compartments through said branch line means and said trunk line means to said retention tank means thereby preventing the spillage of said fluid chemical and petroleum products externally of said cargo compartments.

7. The improvement recited in claim 1, further comprising line flow alarm means, coupled to said trunk line means, for indicating the flow of fluid chemical and petroleum products in said trunk line means.

8. The improvement recited in claim 1, wherein said retention tank means is located adjacent a side of said hull of said vessel.

9. The improvement recited in claim 1, wherein said retention tank means comprises a plurality of interconnected empty compartments of said tanker vessel.

* * * * *